United States Patent [19]

Naylor et al.

[11] 4,328,817

[45] May 11, 1982

[54] SMOKING ARTICLES

[75] Inventors: Donald B. Naylor; Richard R. Baker, both of Southampton, England

[73] Assignee: British-American Tobacco Company Limited, London, England

[21] Appl. No.: 193,747

[22] Filed: Oct. 3, 1980

[30] Foreign Application Priority Data

Oct. 26, 1979 [GB] United Kingdom ..... 7937170

[51] Int. Cl.[3] ..... A24D 1/00; A24C 5/00

[52] U.S. Cl. ..... 131/360; 131/364

[58] Field of Search ..... 131/331, 338, 339, 360, 131/364

[56] References Cited

U.S. PATENT DOCUMENTS 80,287 7/1868 Kneeland ..... 131/364

3,392,735 7/1968 Lebert ..... 131/339

*Primary Examiner*—V. Millin

*Attorney, Agent, or Firm*—Kane, Dalsimer, Kane, Sullivan and Kurucz

[57] ABSTRACT

A smoking article comprises a rod of smoking material, wrapped in a wrapper, in which rod the packing density of the smoking material varies continuously along at least a major portion of the overall length of the rod, but is constant across any section, within said portion, in a plane perpendicular to the longitudinal axis. The smoking material may be of homogeneous constitution throughout the rod. Preferably the density decreases continuously along the said portion of the rod in the direction away from the end of the rod to be lit, from which end the said portion may extend to substantially the other end of the rod. There may be between a 5% and a 40% weight difference between the more dense half of the length of the rod and the less dense half thereof. The density at the less dense end of the rod may be in the range of 170 to 240 mg $cm^{-3}$ and that at the denser end in the range of 290 to 350 mg $cm^{-3}$.

5 Claims, 2 Drawing Figures

SMOKING ARTICLES

Figure 1:
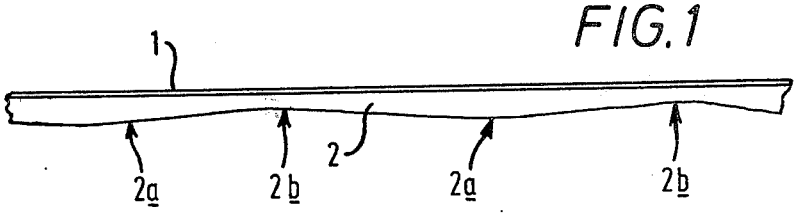

This invention relates to smoking articles, cigarettes for example.

In the manufacture of smoking articles, such as cigarettes, design parameters may be varied in order to control the composition of the tobacco smoke during smoking of the smoking article. Such parameters include tobacco additives, cigarette paper additives, the permeability of the cigarette paper, the composition of the tobacco or other smoking material, the strand width of the smoking material and the filling capacity of the smoking material.

It is known from U.S. Pat. No. 2,918,922 to provide a cigarette in which the packing density of the tobacco rod increases in the radial direction from the longitudinal axis, as well as in a longitudinal direction. Such tobacco rods can be obtained by first manufacturing a comparatively low density tobacco rod of double length wrapped in cigarette paper and then inserting into the rod from each end thereof a stepped plunger.

From U.S. Pat. No. 3,759,267 it is known to provide a smoking article having a filler including a portion of shredded tobacco and a portion of reconstituted tobacco, tobacco substitute or non-combustible material, the two portions adjoining each other either in a plane inclined to the longitudinal axis of the article or at a boundary of frusto-conical shape. Such a smoking article exhibited a more constant, reduced, delivery of total particulate material (T.P.M.) in comparison with a smoking article of the same dimensions and having a filler comprising an intimate mixture of the two filler components.

It is an object of the present invention to provide, in a simple fashion and with a minimum departure from orthodox manufacturing processes, a smoking article which is useful in that the smoke composition can be controlled to meet requirements, for example in order to reduce and/or otherwise control deliveries of T.P.M. and carbon monoxide.

According to the invention, a smoking article comprises a rod of smoking material wrapped in a wrapper, the packing density of said smoking material varying continuously along at least a major portion of the overall length of the said rod, but being constant across any section, within said portion, in a plane perpendicular to the longitudinal axis of the rod. Advantageously, the smoking material is of homogenous constitution exclusive of its packing density, throughout the smoking-material rod.

Preferably, the packing density of the smoking material decreases continuously along the said portion in the direction away from that end of the rod intended for lighting. The said portion may with advantage extend from the end intended for lighting to subtantially the other end of the rod.

If the packing density decreases continuously from one end of the rod to the other, there may be between a 5% and a 40% weight difference between the more dense half-length and the less dense half-length thereof. The packing density at the less dense end of each half may suitably be in the range of, for example, 170 to 240 mg $cm^{-3}$ and that at the denser end in a range of, for example 290 to 350 mg $cm^{-3}$.

EXAMPLE I

Figure 2:
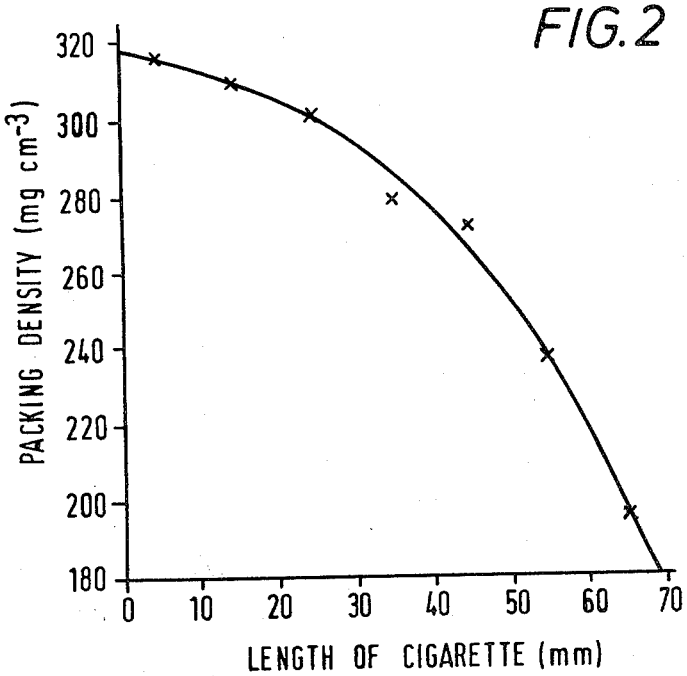

Plain cigarettes having a tobacco-packing density varying continuously from one end to the other were made from tobacco of homogeneous constitution on a Molins Mark 8 SM cigarette-making machine which had been modified generally in accordance with the machine depicted and described in the specification of U.S. Pat. No. 3,880,171. A major difference between the machine used for making the variable-density cigarettes of the present example and the machine of U.S. Pat. No. 3,880,171 was that only one tobacco hopper was employed in the former. The machine was so adjusted and operated that the layer of tobacco deposited on the travelling air-pervious suction band was trimmed, by the trimmer disc knives (ecreteurs), to provide a tobacco-layer profile such as is shown diagrammatically in FIG. 1 of the accompanying drawing, in which the suction band of the machine is designated 1 and the tobacco layer 2. As is apparent from the figure, the profile has alternate crests 2*a* and troughs 2*b* at substantially equal intervals. From the tobacco layer 2, a continuous wrapped tobacco rod was produced in the machine, which rod had denser regions corresponding to the crests 2*a* and less dense regions corresponding to the troughs 2*b*. In per se known manner, the continuous rod was wrapped and cut at points corresponding to the crests 2*a* into rod lengths equal to two cigarette lengths and thereafter at points corresponding to the troughs 2*b* into single cigarette lengths. This method of manufacturing resulted in cigarettes having a tobacco-density variation, determined by weighing cut sections of the cigarette, such as is shown in FIG. 2. The packing density varied from 318 mg $cm^{-3}$ at one end of the cigarette to 180 mg $cm^{-3}$ at the other end. For comparison, control cigarettes were made on the same machine, but with the density-variation modifications removed. The control cigarettes had a constant packing density of 277 mg $cm^{-3}$.

The variable-density cigarettes and the control cigarettes were 69 mm long and of 25 mm circumference. The wrapper was of cigarette paper supplied by Rober Fletcher & Son Limited under the designation 66 M and having a permeability of 9 Coresta Units.

All of the cigarettes were machine smoked under standard conditions, i.e. 35 $cm^3$ puffs of two seconds duration, one per minute, to a butt length of 23 mm. Some of the variable-density cigarettes were smoked with the denser end lit and some with the less dense end lit. Observed results for puff number and for deliveries of total particulate matter (T.P.M.) and carbon monoxide are summarised in Table 1:

TABLE 1

| | Constant Density. Control | Variable Density-Denser End Lit | Variable Density-Less Dense End Lit |
|---|---|---|---|
| Puff No. | 8.1 | 9.6 | 8.2 |
| T.P.M. (mg) | 33.9 | 31.9 | 30.4 |
| Carbon Monoxide (% by volume) | 5.2 | 4.5 | 5.7 |
| Nicotine/μg | 1.60 | 1.81 | 1.59 |

It may be concluded from Table 1 that it is preferable on balance to use variable-density cigarettes lit at the denser end, since not only are an extra 1½ puffs thereby obtained, but both the T.P.M. and the CO deliveries are reduced. A larger reduction in the T.P.M. delivery is obtained with variable-density cigarettes lit at the less dense end. As will be seen, the ratios of the nicotine delivery to the T.P.M. delivery and to the carbon-monoxide delivery are higher in the case of the variable-density cigarettes lit at the denser end than in the case of the control cigarettes. The possibility of controlling not only the total or puff-by-puff deliveries of T.P.M. and carbon monoxide, but also the aforesaid ratios is not uncommonly of significance in the design of cigarettes to meet particular desiderata.

EXAMPLE II

Control and variable-density cigarettes were made by the method of Example I. The cigarettes each comprised a tobacco rod 64 mm in length and a 20 mm long filter attached at one end of the rod (the less dense in the case of the variable-density cigarettes). The cigarette paper was supplied by Robert Fletcher & Son Limited under designation 136 P and had a permeability of 19 Coresta Units. The filters, each of which was in the form of a non-wrapped cellulose acetate filter plug, were attached to the cigarette rods by tipping supplied by Papeteries de Malaucène under the designation 4M0335. The tipping had four rows of laser-formed holes 16 mm from the butt and was attached by overall glueing. The filters had a ventilation of 56%, as measured using the standard conditions with the cigarettes unlit. The cigarettes were smoked under standard conditions to a butt length of 28 mm (including the filter), the variable-density cigarette being smoked with the denser end lit. Observed results are shown in Table 2:

TABLE 2

| | Control | Variable Density |
|---|---|---|
| T.P.M. (mg) | 13.2 | 10.8 |
| Carbon Monoxide (% by volume) | 1.9 | 1.4 |
| Formaldehyde (μg) | 110 | 69 |

From Table 2, it is apparent that significant advantages were achieved in all respects, even in comparison with cigarettes having ventilated filters. No significant difference in nicotine delivery was observed, but the ratios referred to in connection with Table 1 were increased by virtue of, for example, the reduction in T.P.M. delivery.

Design parameters other than such as have been mentioned above could be varied in plain or filter-tipped cigarettes having a variable-density smoking material rod. Thus, for example, the cigarette paper could have a multiplicity of alternate bands of low and high porosity, as disclosed in the Specification of U.S. Pat. No. 4,077,414. The smoking material could be tobacco which has been subjected to an expansion process, for example that disclosed in the Specification of U.K. Pat. No. 1,444,309.

What is claimed is:

1. A smoking article comprising a rod of smoking material wrapped in a wrapper, the packing density of said smoking material varying continuously along at least a major portion of the overall length of the rod, but being constant across any section, within said portion, in a plane perpendicular to the longitudinal axis of the rod, and the packing density decreasing continuously along the portion of the portion of the rod in the direction away from that end of the rod which is to be lit.

2. A smoking article according to claim 1, wherein the smoking material is of homogeneous constitution throughout the rod.

3. A smoking article according to claim 1 or 2, wherein the said portion of the rod extends from the end of the rod to be lit to substantially the other end of the rod.

4. A smoking article comprising a rod of smoking material wrapped in a wrapper, the packing density of said smoking material varying continuously along at least a major portion of the overall length of the rod, but being constant across any section, within said portion, in a plane perpendicular to the longitudinal axis of the rod, the packing density decreases continuously from one end of the rod to the other end in such a manner that there is between a 5% and a 40% weight difference between the more dense half length and the less dense half length of the rod.

5. A smoking article comprising a rod of smoking material wrapped in a wrapper, the packing density of said smoking material varying continuously along at least a major portion of the overall length of the rod, but being constant across any section, within said portion, in a plane perpendicular to the longitudinal axis of the rod, the packing density at the less dense end of the rod is in the range of 170 to 240 mg $cm^{-3}$ and that at the denser end in the range of 290 to 350 mg $cm^{-3}$.

* * * * *